US008352063B2

(12) United States Patent
Sugiyama et al.

(10) Patent No.: US 8,352,063 B2
(45) Date of Patent: Jan. 8, 2013

(54) APPARATUS FOR DETECTING BREAK IN WARP YARN IN LOOM

(75) Inventors: Hiromasa Sugiyama, Aichi-ken (JP); Masanobu Sakai, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 623 days.

(21) Appl. No.: 12/630,979

(22) Filed: Dec. 4, 2009

(65) Prior Publication Data

US 2010/0139804 A1 Jun. 10, 2010

(30) Foreign Application Priority Data

Dec. 10, 2008 (JP) ..... 2008-313797

(51) Int. Cl.
*G06F 19/00* (2011.01)

(52) U.S. Cl. ..... 700/140

(58) Field of Classification Search ..... 700/140; 139/349, 351–355

See application file for complete search history.

(56) References Cited

U.S. PATENT DOCUMENTS

| | | | | |
|---|---|---|---|---|
| 3,670,778 A | | 6/1972 | Meier | |
| 4,523,614 A | * | 6/1985 | Shimizu | 139/355 |
| 5,105,855 A | * | 4/1992 | Stacher | 139/351 |
| 5,437,082 A | * | 8/1995 | Maenaka | 139/351 |
| 6,814,107 B2 | * | 11/2004 | Schwemmlein et al. | 139/351 |
| 2008/0092978 A1 | * | 4/2008 | Beernaert | 139/68 |

FOREIGN PATENT DOCUMENTS

| | | |
|---|---|---|
| CA | 929832 | 7/1973 |
| DE | 567889 | 1/1933 |
| DE | 1292096 | 4/1969 |
| EP | 0052155 | 5/1982 |
| FR | 2571068 | 4/1986 |
| GB | 2043123 | 10/1980 |
| JP | 01-306656 | 12/1989 |
| JP | 5-302241 | 11/1993 |
| JP | 2006-265760 | 10/2006 |
| WO | 2006/117673 | 11/2006 |

* cited by examiner

*Primary Examiner* — Nathan Durham
(74) *Attorney, Agent, or Firm* — Greenblum & Bernstein P.L.C.

(57) ABSTRACT

An apparatus for detecting a break in a warp yarn in a loom includes a heald, a heald frame, a carrier rod, a sensor, a controller and a signal line. The heald is made of a resin material for guiding a warp yarn. The heald frame performs a shedding operation of warp yarns and has the carrier rod for supporting a plurality of the healds. The sensor is provided in the heald for sensing a deformation of the heald caused by a tension of the warp yarn and outputting a signal. The controller is provided for determining a condition of the break in the warp yarn based on the signal of the sensor. The signal line electrically connects to the sensor and the controller.

8 Claims, 4 Drawing Sheets

APPARATUS FOR DETECTING BREAK IN WARP YARN IN LOOM

BACKGROUND OF THE INVENTION

The present invention directs to an apparatus for detecting a break in a warp yarn in a loom in which shedding operation is performed by resin healds.

Generally, a break in a warp yarn is detected by a dropper mechanism which is disposed in a traveling path of warp yarns between a yarn beam and a heald frame. In the dropper mechanism, a number of warp yarns, for example, more than 8,000 warp yarns, has to be set in such a manner that each warp yarn is passed through the corresponding dropper. Passing of warp yarns through the droppers is a troublesome work, and the loom is complicated by the presence of the dropper mechanism. In order to overcome such problems, there are proposed various types of apparatuses for detecting a break in a warp yarn using a heald through which a warp yarn is passed.

An apparatus for detecting a break in a warp yarn is disclosed in Japanese Patent Application Publication No. 5-302241. The apparatus includes an upper heald bar as an upper carrier rod and a lower heald bar as a lower carrier rod. The upper heald bar has a main body which is made of a conductive material and a part of which is exposed and the rest of which is coated with a non-conductive material. The lower heald bar is made of a conductive material. The upper heald bar has at an end thereof a terminal that is movable with the upper heald bar and contactable with a stationary terminal when the upper heald bar is lowered. These terminals form a timing control circuit. The heald made of conductive material such as a stainless steel are passed at the opposite ends thereof through the upper and lower heald bars. In the above structure, when a warp yarn passed through an eye hole of a heald is broken and then the heald is dropped to the lowermost position, the heald is brought into contact with both of the exposed conductive part of the upper heald bar and the lower heald bar made of a conductive material. Simultaneously, the terminal of the upper heald bar is brought into contact with the stationary terminal, thereby closing the timing control circuit. Thus, a break in a warp yarn is detected, and then the loom operation is stopped, accordingly.

The heald made of a conductive material is a relatively heavy in weight and, therefore, the heald tends to overrun due to the inertial force of the heald generated while the heald frame is moving vertically. Thus, there is a fear that the heald is brought into contact with the conductive parts of the upper and lower heald bars when the heald is lowered. In recent weaving looms operating at an increased speed of about 1,000 rpm, the apparatus of the above Publication may fail to detect the break properly. Thus, the apparatus is difficult to be put into practical use. Additionally, the apparatus of the above Publication is complicated in structure and hence expensive.

The present invention which has been made in light of the above problems is directed to an apparatus for detecting a break in a warp yarn which has a simple structure and is capable of reliably detecting a break in a warp yarn by using a deformable characteristics of the resin heald.

SUMMARY OF THE INVENTION

In accordance with the present invention, an apparatus for detecting a break in a warp yarn in a loom includes a heald, a heald frame, a carrier rod, a sensor, a controller and a signal line. The heald is made of a resin material for guiding a warp yarn. The heald frame performs a shedding operation of warp yarns and has a carrier rod for supporting a plurality of the healds. The sensor is provided in the heald for sensing a deformation of the heald caused by a tension of the warp yarn and outputting a signal. The controller is provided for determining a condition of the break in the warp yarn based on the signal of the sensor. The signal line electrically connects to the sensor and the controller.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE PREFERRED EMBODIMENT

Figure 1:
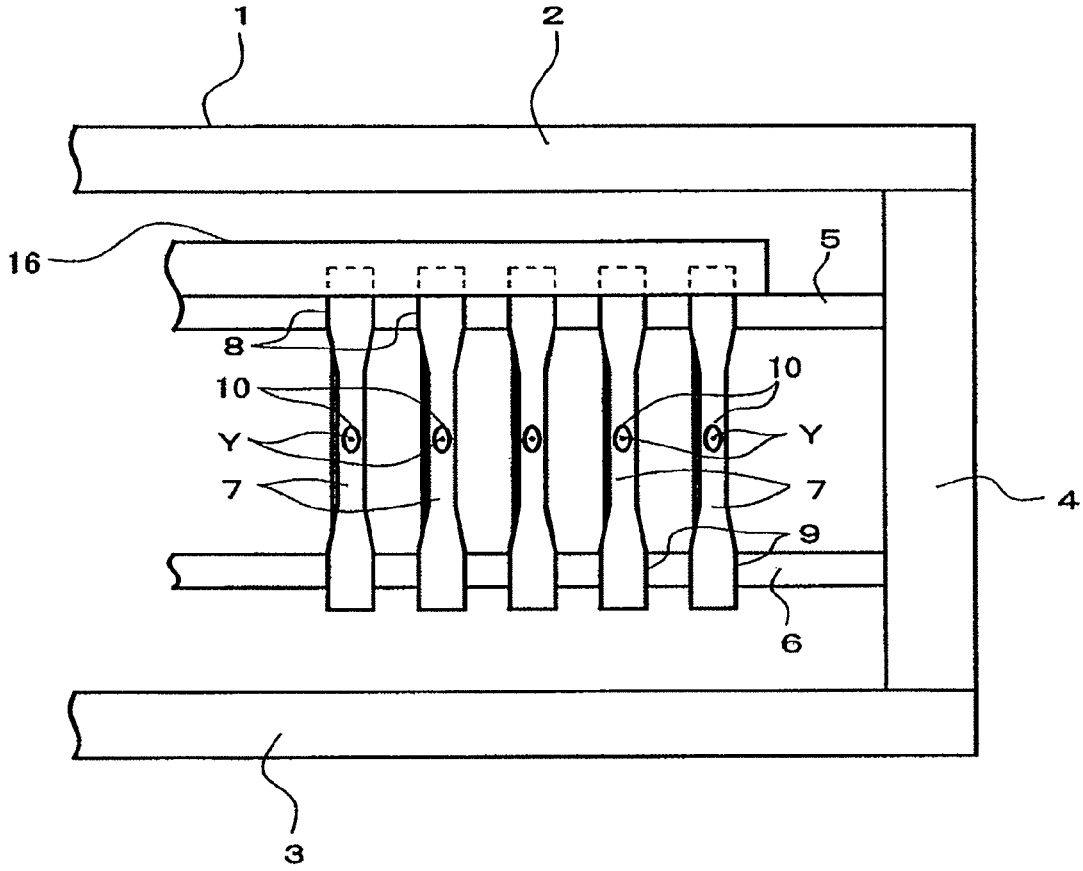
FIG. 1 is a fragmentary partially enlarged view showing a heald frame having an apparatus according to a preferred embodiment of the present invention.

The following will describe the preferred embodiment of the present invention with reference to FIGS. 1 through 4. FIG. 1 shows a heald frame 1 including an apparatus for detecting a break in a warp yarn Y. A weaving loom has many heald frames similar to the heald frame 1 of FIG. 1. Therefore, the following will describe the apparatus for detecting a break in a warp yarn Y using the heald frame 1 of FIG. 1. The heald frame 1 having a rectangular shape in front view includes an upper frame stave 2, a lower frame stave 3 and side stays 4 (only right-hand side stay being shown in FIG. 1).

Rectangular upper and lower carrier rods 5, 6 made of a stainless steel or a ferrous metal are connected at the opposite ends thereof between the side stays 4. A plurality of resin healds 7 is supported by and between the upper and lower carrier rods 5, 6. The resin heald 7 has at the upper and lower ends thereof rectangular holes 8, 9 formed therethrough for slidably receiving therethrough the upper and lower carrier rods 5, 6, respectively. The resin heald 7 further has at the center thereof an eye hole 10 formed therethrough through which a warp yarn Y is passed to be guided (refer to FIGS. 1, 3).

Figure 2:
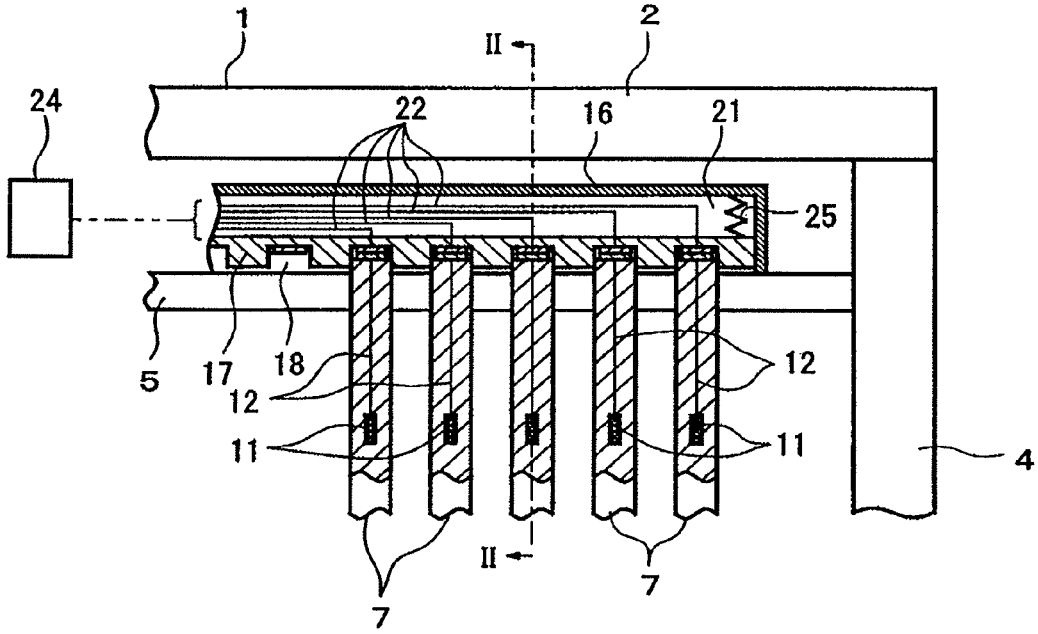
FIG. 2 is a fragmentary partially sectional view of the heald frame in FIG. 1 showing the apparatus according to the preferred embodiment of the present invention.
Figure 3:
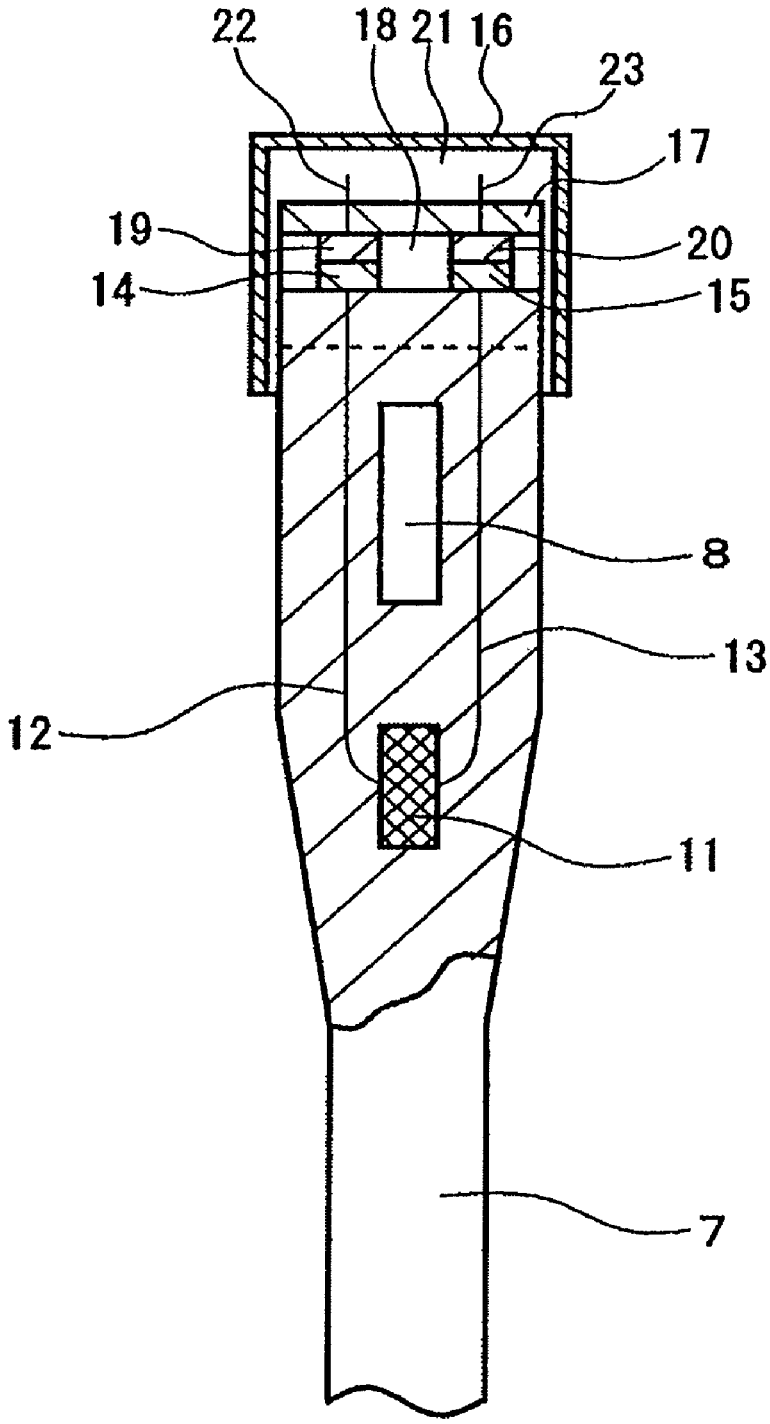
FIG. 3 is a sectional view taken along the line II-II in FIG. 2.

Referring to FIGS. 2 and 3, a strain gage 11 as a sensor is arranged or embedded in the upper end of the resin heald 7 at a position below the hole 8. Two wires 12, 13 as a signal line are also arranged or embedded in the upper end of the resin heald 7 and electrically connected at one ends thereof to the strain gage 11 and at the other ends thereof to terminals 14, 15, respectively, which are fixed to the upper end surface of the resin heald 7 by means of adhesive.

A housing member 16 having a U-shape in cross-section is disposed above the upper carrier rod 5 along the length thereof so as to cover the upper ends of the resin healds 7. The housing member 16 has a press plate 17 therein as a press member which is formed at the lower surface thereof with at least as many recesses 18 formed at the lower surface thereof as the resin healds 7 in the heald frame 1. As shown in FIG. 3, terminals 19, 20 are fixed to the inner top surface of the recess 18 by means of adhesive and the terminals 14, 15 are fixed to the terminals 19, 20, respectively.

Two wires 22, 23 as a signal line extending in the space 21 of the housing member 16 as a signal line through the press plate 17 are electrically connected at one ends thereof to the terminals 19, 20, respectively, and at the other end thereof to a controller 24 which will be described later. The wires 22, 23 for each resin heald 7 are exposed out of the heald frame 1 through any suitable means of the loom and electrically connected to the controller 24 which is provided in the loom frame. The terminals 14, 15, 19, 20 and the wires 22, 23 are covered with a non-conductive material. The controller 24 may be disposed in the loom other than the loom frame.

Arranging the housing member 16 above the upper carrier rod 5 which is passed through the resin healds 7, the resin healds 7 are fitted at the upper ends thereof in the recesses 18 of the press plate 17. Thus, the terminals 14, 15 of the resin heald 7 and the terminals 19, 20 of the press plate 17 are in close contact with each other, respectively. The press plate 17 is urged by a spring 25 arranged in the space 21 of the housing member 16 in such direction that causes the terminals 14, 15 to be in close contact with the terminals 19, 20, respectively. The resin healds 7 are fixed at the upper ends thereof to the respective recesses 18 of the press plate 17, so that the resin healds 7 are secured in place, and vibration caused by the shedding operation of the loom is suppressed.

The strain gage 11 is provided in the resin heald 7 for sensing a deformation of the heald 7 caused by a tension of the warp yarn Y and outputting an electrical signal. The controller 24 determines a condition of a break in a warp yarn Y in comparison between the signal of the strain gage 11 and the threshold value P. Specifically, variation of resistance value of the strain gage 11 is measured by the controller 24, thereby determining the deformation of the resin heald 7 in terms of the resistance. The controller 24 receives from the strain gage 11 an electrical signal representing the extent of resin heald deformation and a threshold value P for the deformation is set in the controller 24. The threshold value P is set at least larger than the deformation of the resin heald 7 occurring about when a warp shed is closed so that a decrease of the warp yarn tension during shed closing is distinguished from a decrease of the warp yarn tension due to a break in a warp yarn Y.

Detection time Q for sensing the deformation of the heald 7 by the strain gage 11 is also set in the controller 24. The detection time Q is set in the range of time during which a warp shed is opened, that is easily distinguishable from the time when a warp yarn break occurs. Particularly, the tension of warp yarns Y is high during the range including the time when the warp yarn Y is the maximum shed opening position (the time when a warp shed is wide open), that is easily distinguishable from the time when a warp yarn break occurs. Therefore, the detection time Q should preferably be set at any time within the above time. The detection time Q may be set at a time corresponding to the beginning or the end of the above time.

Either one of the threshold value P and the detection time Q may be set as in an alternative embodiment which will be described later. However, both of the threshold value P and the detection time Q may be set for an increased accuracy in the detection of a warp yarn break.

Figure 4:
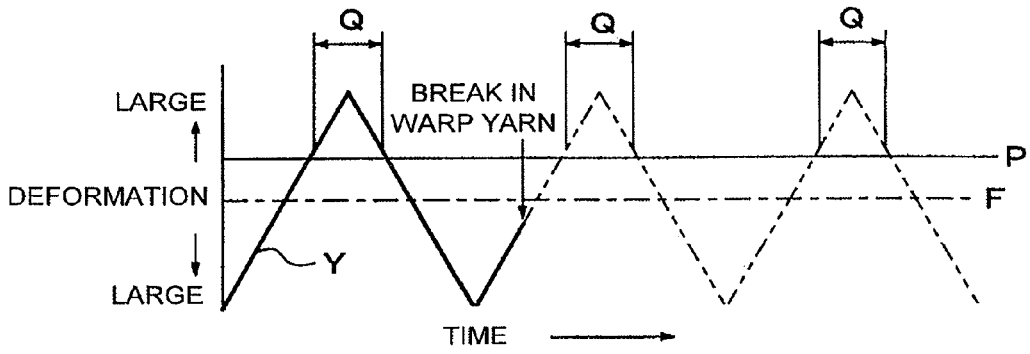
FIG. 4 is a diagram illustrating a deformation of a resin heald during a shedding operation of warp yarns according to the preferred embodiment of the present invention.

The operation of the apparatus according to this preferred embodiment is as follows. During the weaving operation of the loom using the heald frame 1 shown in FIGS. 1 through 3, warp yarns Y supported by the resin healds 7 are moved vertically thereby to alternately open and close a shed. As shown in FIG. 4, the tension of warp yarns Y becomes extremely small at the minimum shed opening position F and the deformation of the resin healds 7 becomes extremely small, accordingly.

When a warp yarn Y is being moved toward the maximum shed opening position on the upper side (top of the diagram in FIG. 4) or the maximum shed opening position on the lower side (bottom of the diagram in FIG. 4), the resin heald 7 is subjected to a large tension of the warp yarn Y and deformed. The deformation of the resin heald 7 becomes the largest at the respective maximum shed opening positions. The deformation of the resin heald 7 causes the strain gage 11 to be deformed, so that the resistance of the strain gage 11 is varied significantly, accordingly. However, if a break in the warp yarn Y occurs, the resin heald 7 receives no tension of the warp yarn Y when the resin heald 7 is located at the maximum shed opening position. Therefore, no deformation occurs in the strain gage 11.

At the predetermined detection time Q, the controller 24 starts to measure the resistance of the strain gage 11 thereby to determine the deformation of the resin heald 7. Then, the measured deformation of the resin heald 7 is compared to the predetermined threshold value P. If the measured deformation is larger than the threshold value P, the warp yarn Y is determined to be in a normal condition and, therefore, the loom continues to operate. Meanwhile, if the measured deformation of the resin heald 7 is smaller than the threshold value P, the warp yarn Y is determined to be broken and, therefore, the loom operation is stopped. Any break in a warp yarn Y during the loom operation is detected at the detection time Q after the break. Thus, any break in a warp yarn Y may be detected without fail.

In the preferred embodiment shown in FIG. 4, the detection time Q is set at a time when the warp yarn Y is moved to a position around the maximum shed opening position on the upper side. However, the detection time Q may be set at a time when the warp yarn Y is moved to a position around the maximum shed opening position on the opposite lower side. In either case, the same effect is obtained. If the detection time Q is set at times on both of the upper and lower sides, a warp yarn break may be detected earlier. Since the shed opening on the upper and lower sides are substantially the same, a single threshold value P may be set.

The preferred embodiment offers the following advantageous effects.

(1) The preferred embodiment according to the present invention dispenses with a dropper mechanism merely by providing a strain gage 11 embedded in a resin healds 7 for detecting a break in a warp yarn Y.

(2) According to this preferred embodiment, the resin healds 7 are supported at the top thereof in the recesses 18 of the press plate 17, which helps to stabilize the shedding operation of warp yarns Y. Furthermore, such arrangement of the resin healds 7 suppresses the vibration generated by vertical movement of the heald frame 1, thereby preventing noise generation and contact between adjacent resin healds 7 which may cause damage to the resin healds 7.

(3) According to this preferred embodiment, the press plate 17 urged by the spring 25 keeps the terminals 14, 15 to be in contact with the terminals 19, 20, respectively, during high speed operation of the heald frame 1.

The present invention is not limited to the above-described embodiment, but it may be variously modified within the scope of the invention, as exemplified below.

According to the above-described embodiment of the present invention, the strain gage 11 is disposed in an upper part of the resin heald 7. Alternatively, the strain gage 11 may be disposed in a lower part of the resin heald 7.

The strain gage 11 need not be embedded, but it may be disposed on the surface of the resin heald 7 so as to be exposed. In such an exposed structure, it is preferable that the strain gage 11 and the wires 12, 13 should be covered with a non-conductive material.

The sensor for use in the present invention is not limited to a strain gage such as the strain gage 11 of the above-described embodiment, but it may be a device using a piezoelectric element which is operable to output electric signals by application of pressure produced by deformation of the resin heald 7.

According to the present invention, either one of the threshold value P and the detection time Q may be used. In such a case, the same advantageous effects as those of the above-described embodiment may be obtained. In the case in which only the threshold value P is used, the controller 24 may determine a condition of a break in a warp yarn Y when the deformation of a resin heald 7 becomes lower than the threshold value P in operation of the loom. When a break in a warp yarn Y occurs, the tension of the warp yarn Y applied to the resin heald 7 is almost zero. Meanwhile, the tension of the warp yarn Y applied to the resin heald 7 at the minimum shed opening position is much lower than that at the maximum shed opening position, but the tension is not zero. Thus, improving the measurement accuracy of the controller 24, a condition of any break occurring in a warp yarn Y may be determined. In the case in which only the detection time Q is used, on the other hand, the controller 24 may determine a condition of a break in a warp yarn Y when the rate of variation of a resin heald deformation during the detection time Q exceeds a predetermined value.

What is claimed is:

1. An apparatus for detecting a break in a warp yarn in a loom comprising:

a heald made of a resin material for guiding a warp yarn;

a heald frame performing a shedding operation of warp yarns, the heald frame having a carrier rod, the carrier rod for supporting a plurality of the healds;

a sensor provided in the heald for sensing a deformation of the heald caused by a tension of the warp yarn and outputting a signal;

a controller for determining a condition of the break in the warp yarn based on the signal of the sensor; and a signal line electrically connects to the sensor and the controller.

2. The apparatus for detecting the break in the warp yarn according to claim 1, wherein a threshold value for the deformation of the heald is set in the controller, the controller determines the condition of the break in the warp yarn in comparison between the signal of the sensor and the threshold vale.

3. The apparatus for detecting the break in the warp yarn according to claim 1, wherein a detection time for sensing the deformation of the heald by the sensor is set in a range including the time when a warp yarn is the maximum shed opening position.

4. The apparatus for detecting the break in the warp yarn according to claim 1, wherein the sensor is a strain gage.

5. The apparatus for detecting the break in the warp yarn according to claim 4, wherein the strain gage is arranged in the heald.

6. The apparatus for detecting the break in the warp yarn according to claim 1, further comprising a housing member disposed along the length of the carrier rod and a terminal arranged between the housing member and the heald, wherein the signal line electrically connected to the sensor is arranged in the heald, the signal line electrically connected to the controller is arranged in the housing member, the signal line in the heald and the signal line in the housing member are electrically connected to each other through the terminal.

7. The apparatus for detecting the break in the warp yarn according to claim 6, further comprising a press member formed in the housing member with recesses, wherein the terminal includes two terminals, one terminal is fixed to the inner top surface of the recess, and the other terminal is fixed to the upper end surface of the heald, the terminals are in electrical contact with each other.

8. The apparatus for detecting the break in the warp yarn according to claim 7, further comprising a spring arranged in the housing member for urging the press member in a direction that the terminals are in close contact with each other.

* * * * *